US008004171B2

(12) United States Patent
Yamashita et al.

(10) Patent No.: US 8,004,171 B2
(45) Date of Patent: Aug. 23, 2011

(54) DIELECTRIC LAYER CONTAINING CARBON FOR A PLASMA DISPLAY PANEL

(75) Inventors: Hideki Yamashita, Osaka (JP); Hironobu Inoue, Osaka (JP); Motoi Hatanaka, Osaka (JP); Tomohiro Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 225 days.

(21) Appl. No.: 12/118,534

(22) Filed: May 9, 2008

(65) Prior Publication Data

US 2008/0278055 A1 Nov. 13, 2008

(30) Foreign Application Priority Data

May 11, 2007 (JP) ..... P2007-126384

(51) Int. Cl.
*H01J 17/49* (2006.01)
*H01J 9/00* (2006.01)

(52) U.S. Cl. ..... 313/487; 313/581; 313/586; 313/495; 313/497; 313/498

(58) Field of Classification Search ..... 313/495–498, 313/581–587
See application file for complete search history.

(56) References Cited

U.S. PATENT DOCUMENTS

| | | | | |
|---|---|---|---|---|
| 6,731,496 | B2 * | 5/2004 | Hiramatsu et al. | 361/321.2 |
| 2001/0005115 | A1 | 6/2001 | Busio et al. | |
| 2003/0038599 | A1 | 2/2003 | Aoki et al. | |
| 2005/0104520 | A1 * | 5/2005 | Hong et al. | 313/582 |
| 2007/0013311 | A1 * | 1/2007 | Moon et al. | 313/586 |
| 2007/0099005 | A1 * | 5/2007 | Leung et al. | 428/447 |

FOREIGN PATENT DOCUMENTS

| | | |
|---|---|---|
| JP | 11-195382 | 7/1999 |
| JP | 2003-518318 | 6/2003 |
| KR | 2001-0037347 | 5/2001 |
| KR | 2002-0080500 | 10/2002 |

* cited by examiner

*Primary Examiner* — Anne Hines
*Assistant Examiner* — Tracie Green
(74) *Attorney, Agent, or Firm* — Wenderoth, Lind & Ponack, L.L.P.

(57) ABSTRACT

A plasma display panel including a front panel having a first substrate, a first electrode, a first dielectric layer and a protective layer wherein the first electrode is formed on the first substrate, the first dielectric layer is formed over the first substrate so as to cover the first electrode, and the protective layer is formed on the first dielectric layer, and a rear panel having a second substrate, a second electrode, a second dielectric layer and a phosphor layer wherein the second electrode is formed on the second substrate, the second dielectric layer is formed over the second substrate so as to cover the second electrode, the phosphor layer is formed on the second dielectric layer.

2 Claims, 7 Drawing Sheets

DIELECTRIC LAYER CONTAINING CARBON FOR A PLASMA DISPLAY PANEL

BACKGROUND OF THE INVENTION

I. Field of the Invention

The present invention relates to a plasma display panel. In particular, the present invention relates to a plasma display panel characterized by a carbon concentration of a dielectric layer thereof. The present invention also relates to a method for producing such a plasma display panel.

II. Description of Related Art

The market for large screen flat-panel displays has been recently growing. In these circumstances, a plasma display panel suited to high-definition pictures and a large screen has been further developed.

The plasma display panel comprises a front panel and a rear panel opposed to each other. The front panel and the rear panel are sealed along their peripheries. Between the front panel and the rear panel, there is formed a discharge space filled with a discharge gas (helium, neon or the like).

The front panel is generally provided with a glass substrate, display electrodes (each of which comprises a scan electrode and a sustain electrode), a dielectric layer and a protective layer. Specifically, (i) on one of principal surfaces of the glass substrate, the display electrodes are formed in a form of stripes; (ii) the dielectric layer is formed on the principal surface of the glass substrate so as to cover the display electrodes; and (iii) the protective layer is formed on the dielectric layer so as to protect the dielectric layer.

The rear panel is generally provided with a glass substrate, address electrodes, a dielectric layer, partition walls and phosphor layers (i.e. red, green and blue fluorescent layers). Specifically, (i) on one of principal surfaces of the glass substrate, the address electrodes are formed in a form of stripes; (ii) the dielectric layer is formed on the principal surface of the glass substrate so as to cover the address electrodes; (iii) a plurality of partition walls are formed on the dielectric layer at equal intervals; and (iv) the phosphor layers are formed on the dielectric layer such that each of them is located between the adjacent partition walls.

In operation of the plasma display panel, ultraviolet rays are generated in the discharge space upon applying a voltage, and thereby the phosphor layers capable of emitting different visible lights are excited. As a result, the excited phosphor layers respectively emit lights in red, green and blue colors, which will lead to an achievement of a full-color display.

The dielectric layers can serve as a capacitor. Especially as for the dielectric layer of the front panel, not only a high performance of capacitor is required for achieving a high efficiency of the discharge, but also a resistance to a dielectric breakdown phenomenon is required (such breakdown phenomenon may occur when the voltage is applied on the dielectric layer). See Japanese Patent Kohyo Publication No. 2003-518318 and Japanese Patent Kokai Publication No. 11-195382, for example.

Especially in recent years, there has been an increasing demand for a higher definition and a lower power consumption of the plasma display panels. Thus, some research has been done in order to increase not only the energy effectiveness of the discharge gas but also the number of scanning lines. The realization of a higher definition leads to a smaller pitch between the electrodes, and thereby the dielectric breakdown may occur between the electrode and the dielectric layer upon applying the voltage. For this reason, it is required that the dielectric layer has a lesser physical defect, such as peeling or cracking therein or on its surface.

Moreover, the smaller the panel opening area becomes, the lower the panel brightness becomes. Thus, the dielectric layer is required to have a high purity and a low dielectric constant (or low permittivity). To this end, it is necessary to prevent the dielectric layer from turning yellow. This yellow discoloration of the dielectric layer is known as "yellowing" or "yellowing phenomenon" wherein the dielectric layer is deteriorated to turn yellowish due to a secondary reaction with the electrodes upon calcining the dielectric layer.

Therefore, an object of the present invention is to provide a plasma display panel characterized by a dielectric layer substantially free from the cracking, the yellowing and the like.

SUMMARY OF THE INVENTION

In order to achieve the object described above, the present invention provides a plasma display panel comprising:

a front panel comprising a first substrate, a first electrode, a first dielectric layer and a protective layer wherein the first electrode is formed on the first substrate, the first dielectric layer is formed over the first substrate so as to cover the first electrode, and the protective layer is formed on the first dielectric layer; and a rear panel comprising a second substrate, a second electrode, a second dielectric layer and a phosphor layer wherein the second electrode is formed on the second substrate, the second dielectric layer is formed over the second substrate so as to cover the second electrode, the phosphor layer is formed on the second dielectric layer, wherein the front panel and the rear panel are disposed such that the protective layer and the phosphor layer are opposed to each other, and thereby a discharge space is formed between the front panel and the rear panel; and at least the first dielectric layer has a carbon concentration (or carbon component concentration) of from about $1.0\times10^3$ ppm to about $1.0\times10^5$ ppm.

As used in this specification and claims, "carbon concentration" substantially means a carbon (C) content of the dielectric layer, the carbon (C) content being measured by a secondary ion mass spectrometry (SIMS)("SIMS" will be described later in Example). The carbon is preferably derived from an alkyl group or an alkylene group bonded to a siloxane backbone (i.e. "siloxane linkage" or "siloxane bond") contained in the dielectric layer.

As used in this specification and claims, the phrase "at least the first dielectric layer has a carbon concentration" substantially means "the first dielectric layer has a carbon concentration" or "each of the first and second dielectric layers has a carbon concentration".

The present invention is characterized in that the concentration of carbon remaining in the first dielectric layer or in each of the first and the second dielectric layers is in the range of from $1.0\times10^3$ ppm to $1.0\times10^5$ ppm. In other words, the carbon concentration (or carbon content) of the first dielectric layer or of each of the first and the second dielectric layers is "$1.0\times10^3$ ppm or higher" and "$1.0\times10^5$ ppm or lower". Due to this carbon concentration, there is substantially no cracking and peeling-off in the dielectric layer, and also the yellowing phenomenon is substantially prevented from occurring in the dielectric layer.

In one preferred embodiment, the carbon concentration of the first dielectric layer or of each of the first and the second dielectric layers is in the range of from about $1.0\times10^4$ ppm to about $1.0\times10^5$ ppm. In another preferred embodiment, the first dielectric layer has a two-layered structure composed of a lower layer (i.e. layer being in contact with the electrode) and an upper layer (i.e. layer being in contact with the protective layer) wherein the lower layer has the carbon concentration of from $1.0\times10^3$ ppm to $1.0\times10^4$ ppm, and the upper layer has the carbon concentration of from $1.0\times10^3$ ppm to $1.0\times10^5$ ppm. In this embodiment, the carbon concentration of the lower layer which is in contact with the first electrodes is characterized in that it serves to prevent the yellowing phenomenon. The meaning of the phrase "two-layered structure" used in this specification and claims includes not only an embodiment wherein the upper layer is clearly distinguished from the lower layer, but also an embodiment the upper layer is not clearly distinguished from the lower layer (for example, an interface or boundary between the upper layer and the lower layer is not clearly formed).

In another preferred embodiment, the plasma display panel comprises another dielectric layer provided between the first dielectric layer and the first electrodes wherein the another dielectric layer has the carbon concentration of $10^4$ ppm or lower (i.e. carbon concentration ranging from 0 to $1.0\times10^4$ ppm). In this case, an occurrence of the yellowing phenomenon is more effectively prevented. It should be noted that this embodiment may be regarded as being equivalent to an embodiment wherein the first dielectric layer has the two-layered structure and the lower layer thereof (i.e. layer being in contact with the electrode) has the carbon concentration of $10^4$ ppm or lower.

The present invention also provides a method for producing a plasma display panel as described above, wherein a dielectric layer of a front panel and a dielectric layer of a rear panel are formed. According to the method of the present invention, the formation of at least one of the front-sided and rear-sided dielectric layers comprises the steps of:

(1) supplying a dielectric material onto a substrate (the substrate being provided with an electrode thereon), the dielectric material comprising an organic solvent and a glass component (the glass component comprising an alkyl or alkylene group bonded to a siloxane backbone thereof); and (2) heating the supplied dielectric material; wherein a dielectric layer produced from the dielectric material due to the heating has a carbon concentration of from $1.0\times10^3$ ppm to $1.0\times10^5$ ppm.

The method of the present invention is characterized by the use of the dielectric material comprising the glass component in which the alkyl group or the alkylene group is bonded to the siloxane backbone (i.e. "siloxane bond" or "siloxane linkage"). With respect to the glass component, the molar ratio of the alkyl group to Si atom of the siloxane backbone is preferably 1 or more, and more preferably in the range from 1 to 3. It is preferred that the alkyl group has 1 to 6 carbon atoms.

As described above, the dielectric material used in the method of the present invention comprises the glass component and the organic solvent. However, if needed, the dielectric material additionally may comprise a binder resin.

Due to the carbon concentration, the dielectric layer of the plasma display panel substantially does not have physical defects such as peeling or cracking. This results in a high resistance to the dielectric breakdown phenomenon, and thereby a higher definition of the plasma display panels can be achieved. In other words, even when a high voltage is applied, there is occurred no "dielectric breakdown phenomenon" in the dielectric layer, which will lead to an achievement of high definition of the plasma display panel. Moreover, due to the carbon concentration of the dielectric layer, the yellowing of the dielectric layer is substantially prevented, which makes it possible to compensate for the decrease of the panel brightness attributable to the smaller panel opening area.

Accordingly, the present invention can achieve a higher definition, a lower power consumption and a higher efficiency of the plasma display panels.

DETAILED DESCRIPTION OF THE INVENTION

Hereinafter, the plasma display panel and the method for producing the same of the present invention will be described in detail.

(Construction of Plasma Display Panel of Present Invention)

The plasma display panel (hereinafter referred to also as PDP) of the present invention will be described.

Figure 1:
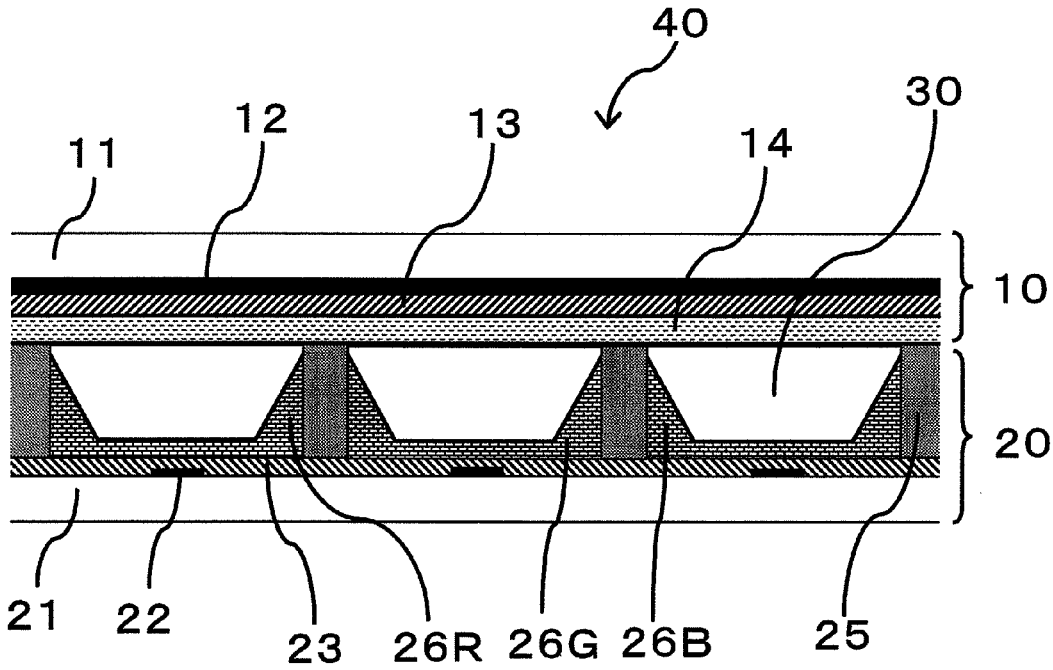
FIG. 1 is a sectional view schematically showing the PDP of the present invention.
Figure 2:
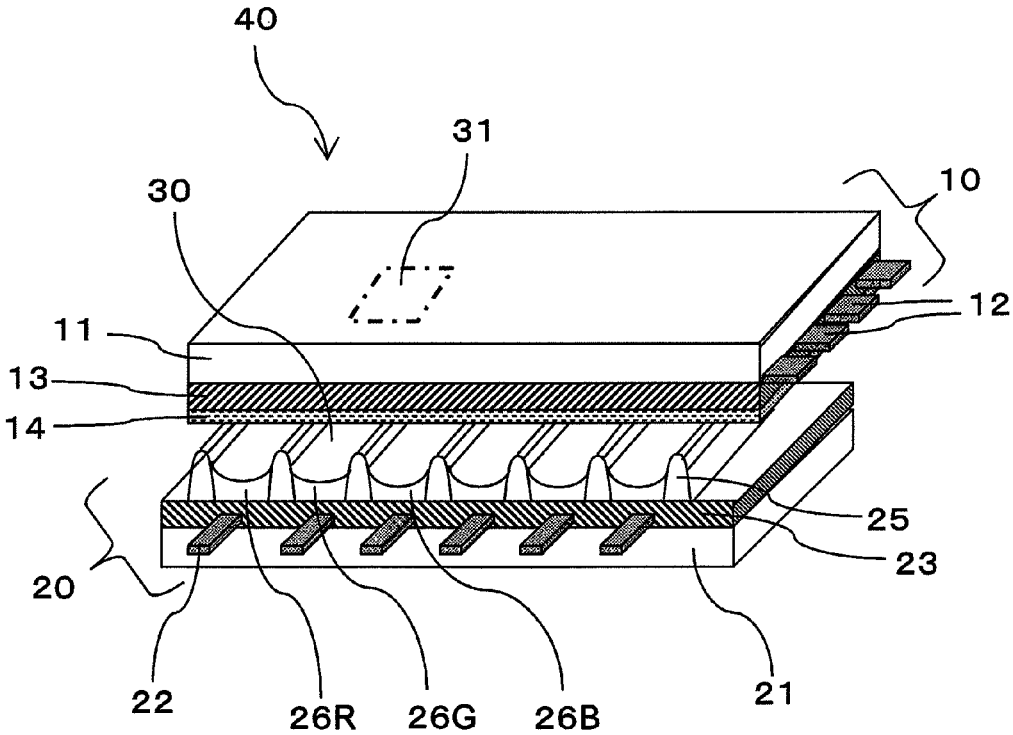
FIG. 2 is a perspective and sectional view schematically showing the PDP of the present invention.

FIG. 1 and FIG. 2 schematically show the PDP of the present invention (specifically, FIG. 1 schematically shows a cross-sectional view of the PDP, and FIG. 2 schematically shows a perspective cross-sectional view of the PDP). The PDP 40 is constituted from a front panel 10 and a rear panel 20. The front panel 10 and the rear panel 20 are arranged so that they face each other. The front panel 10 and the rear panel 20 are sealed together along their peripheries by use of a sealing material (e.g. frit glass having a low melting point). Between the front panel 10 and the rear panel 20, a discharge space is formed and filled with a discharge gas (e.g. helium, neon, xenon or the like).

Turning now to FIG. 1 and FIG. 2, the construction of the PDP 40 of the present invention will be described in more detail. The PDP 40 comprises:

the front panel 10 comprising a first substrate 11, first electrodes 12, a first dielectric layer 13 and a protective layer 14 wherein the first electrodes 12, the first dielectric layer 13 and the protective layer 14 are provided on the first substrate 11; and the rear panel 20 comprising a second substrate 21, second electrodes 22, a second dielectric layer 23 and phosphor layers (26R, 26G, 26B) wherein the second electrodes 22, a second dielectric layer 23 and the phosphor layers (26R, 26G, 26B) are provided on the second substrate 21.

In the front panel 10, the first electrodes 12 are formed on the first substrate 11; the first dielectric layer 13 is formed on the first substrate 11 so that the first electrodes 12 are covered with the first dielectric layer 13; and the protective layer 14 is formed on the first dielectric layer 13.

In the rear panel 20, the second electrodes 22 are formed on the second substrate 21; the second dielectric layer 23 is formed on the second substrate 21 so that the second electrodes 22 are covered with the second dielectric layer 23; and the phosphor layers (26R, 26G, 26B) are formed on the second dielectric layer 23.

The front panel 10 and the rear panel 20 are disposed so that the protective layer 14 and the phosphor layers (26R, 26G, 26B) are opposed to each other.

There is formed a discharge space 30 (or discharge cells 31) between the front panel 10 and the rear panel 20.

The construction of the PDP and the method for producing the PDP according to the present invention will be described in much more detail. The front panel 10 of the PDP of the present invention comprises the first substrate 11, the first electrodes 12, the first dielectric layer 13 and the protective layer 14. The first substrate 11 is a transparent substrate having an electrical insulating property. The thickness of the first substrate 11 may be in the range of from about 1.0 mm to about 3 mm. The first substrate 11 may be a float glass substrate produced by a floating process. The first substrate 11 may also be a soda lime glass substrate, a lead alkali silicate glass substrate or a borosilicate glass substrate. A plurality of the first electrodes 12 are formed in a pattern of parallel stripes on the first substrate 11. It is preferred that the first electrode 12 is a display electrode (whose thickness is for example about 1 μm to about 50 μm) which is composed of a scan electrode and a sustain electrode. Each of the scan electrode and the sustain electrode is composed of a transparent electrode and a bus electrode. The transparent electrode may be an electrically conductive transparent film made of indium oxide (ITO) or tin oxide ($SnO_2$) in which case the visible light generated from the phosphor layer can go through the film. The bus electrode is formed on the transparent electrode, and serves to reduce a resistance of the display electrode and give an electrical conductivity in the longitudinal direction for the transparent electrode.

The first dielectric layer 13 is provided to cover the first electrodes 12 formed on the surface of the first substrate 11. The first dielectric layer 13 may be an oxide film (e.g. silicon oxide film). Such oxide film can be formed by applying a dielectric material paste consisting mainly of a glass component and an organic solvent, followed by heating the dielectric material paste. As described above or as will be described later in detail, the first dielectric layer 13 of the PDP 40 is characterized in that the carbon concentration is in the range of from $10^3$ ppm to $10^5$ ppm. It is preferred that the thickness of the first dielectric layer 13 is in the range of from about 5 μm to about 50 μm. On the first dielectric layer 13, there is formed the protective layer 14 whose thickness is for example from about 0.5 μm to about 1.5 μm. The protective layer 14 serves to protect the first dielectric layer 13 from a discharge impact (more specifically, from the impact of ion bombardment attributable to the plasma). For example, the protective layer 14 is made of magnesium oxide (MgO). The protective layer 14 can be formed by electron-beam vapor deposition process, CVD process, sputtering process or the like.

The rear panel 20 of the PDP of the present invention comprises the second substrate 21, the second electrodes 22, the second dielectric layer 23 and the phosphor layers (26R, 26G, 26B). The second substrate 21 is a transparent substrate having an electrical insulating property. The thickness of the second substrate 21 may be in the range of from about 1.0 mm to about 3 mm. The second substrate 21 may be a float glass substrate produced by a floating process. The second substrate 21 may also be a soda lime glass substrate, a lead alkali silicate glass substrate or a borosilicate glass substrate. Furthermore, the second substrate 21 may also be a substrate made of various ceramic materials. A plurality of the second electrodes 22 are formed in a pattern of parallel stripes on the second substrate 21. For example, the second electrode 22 is an address electrode or a data electrode (whose thickness is for example about 1 μm to about 4 μm). The address electrodes serve to cause the discharge to occur selectively in particular discharge cells. The address electrodes can be formed from an electrically conductive paste including silver as a main component. The application of the electrically conductive paste is performed by a screen printing process, followed by a drying. Alternatively, the address electrodes can also be formed by a photolithography process wherein a photosensitive paste including silver as a main component is applied by die coating method or printing method, followed by drying the applied paste at a temperature condition of from about 100° C. to about 200° C., followed by exposing to light and developing to form an electrode pattern. After that, the calcination is performed at a temperature condition of from about 400° C. to about 700° C. so as to form the address electrodes.

The second dielectric layer 23 is provided to cover the second electrodes 22 formed on the surface of the second substrate 21. The second dielectric layer 23 is an oxide film (e.g. silicon oxide film). Such oxide film can be formed by applying a dielectric material paste consisting mainly of a glass component and an organic solvent, followed by heating the dielectric material paste. As described above or as will be described later in detail, the second dielectric layer 23 of the PDP 40 is characterized in that the carbon concentration is in the range of from $10^3$ ppm to $10^5$ ppm. It is preferred that the thickness of the second dielectric layer 23 is in the range of from about 5 μm to about 50 μm. On the second dielectric layer 23, there is formed the phosphor layers (26R, 26G, 26B) whose thickness is for example from about 5 μm to about 50 μm. The phosphor layers (26R, 26G, 26B) serve to convert the ultraviolet ray emitted due to the discharge into visual light ray. The three-kinds of the phosphor layer (26R, 26G, 26B) constitute a basic unit wherein three kind of fluorescent material layers, each of which is separated from each other by the partition walls 25, are respectively capable of emitting red, green and blue lights. The partition walls 25 serve to divide the discharge space into cells each of which is allocated to one of the address electrodes 22. The phosphor layers (26R, 26G, 26B) can be made from a paste consisting of a fluorescent material powder, a binder resin (for example, polyvinyl alcohol, polyvinyl butyral, a methacrylate ester polymer, an acrylate ester polymer) and an organic solvent (for example, ketones such as methyl ethyl ketone; aromatic hydrocarbons such as toluene; glycol ether such as propylene glycol monomethyl ether). The paste is applied by a die coating process, a printing process, a dispensing process, an ink jet process or the like, followed by drying the applied paste at about 100° C. to form the phosphor layers therefrom. The fluorescent material powder may be such as $Y_2O_3$:Eu, $YVO_4$:Eu or $Y_2O_3S$:Eu for the red fluorescent material powder, $Zn_2GeO_2$:M, $BaAl_{12}O_{19}$:Mn or $LaPO_4$:Tb for the green fluorescent material powder, and $Sr_5(PO_4)_3Cl$:Eu, $BaMg_2Al_{14}O_{24}$:Eu for the blue fluorescent material powder.

The partition walls 25 are provided in a form of stripes or in two pairs of perpendicularly intersecting parallel lines on the second dielectric layer 23. The partition walls 25 can be made from a paste consisting of a glass power having a low melting point (for example, glass powder based on lead oxide-boron oxide-silicon oxide or lead oxide-boron oxide-silicon oxide-zinc oxide etc.), a filler (for example, oxide ceramics or the like), a binder resin (for example, polyvinyl alcohol, polyvinyl butyral, methacrylate ester polymer, acrylate ester polymer, etc.) and an organic solvent (for example, ketones such as methyl ethyl ketone; aromatic hydrocarbons such as toluene; glycol ether such as propylene glycol monomethyl ether). Such paste is applied by a die coating process or a printing process, followed by drying the applied paste at a temperature from about 100 to 200° C., followed by performing a photolithography process to form a partition pattern through the exposure and development. After the photolithography process, the calcination is performed at a temperature from about 400° C. to 700° C. to form the partition walls 25 from the paste. Alternatively, the partition walls 25 may also be formed through a sand blasting process, an etching process or a molding process.

The front panel 10 and the rear panel 20 are disposed so that the protective layer 14 and the phosphor layers (26R, 26G, 26B) are opposed to each other. The discharge space 30 is formed between the front panel 10 and the rear panel 20. More specifically, the front panel 10 and the rear panel 20 are disposed via the discharge space in such an arrangement as the scan electrodes and the sustain electrodes of the front panel 10 cross the address electrodes 22 of the rear panel 20 at right angles. The opposed front panel 10 and the rear panel 20 are heated while being secured in place, and thereby there is formed an airtight seal between the front panel 10 and the rear panel 20. Subsequently, the front panel 10 and the rear panel 20 are subjected to an evacuation baking step to remove the gas from the discharge space 30 while heating. After that, the discharge space 30 is filled with the discharge gas, which makes it possible to complete the manufacturing process of the PDP 40. As the discharge gas, a noble gas or rare gas (e.g. helium, neon, argon or xenon gas) may be used. Such noble gas is injected into the discharge space 30 so that the pressure of the space 30 becomes in the range of from 400 to 600 Torr.

In the PDP 40, the discharge space 30 is divided by the partition walls 25 into the discharge cells 31. In each of the discharge cells 31, there is provided a intersection portion of the address electrodes 22 and the display electrodes 12. As a result, the discharge cells arranged in a form of matrix serve to constitute the display region. The discharge gas is caused to discharge by applying a picture signal voltage selectively to the display electrodes from an external drive circuit. The ultraviolet ray generated due to the discharge of the discharge gas can excite the phosphor layers so as to emit visible lights of red, green and blue colors therefrom, which will lead to an achievement of a display of color images or pictures.

Hereinafter, according to the present invention, the carbon concentration of the PDP dielectric layer will be described in more detail.

(Correlation between Carbon Concentration and Dielectric Layer Thickness)

Figure 3:
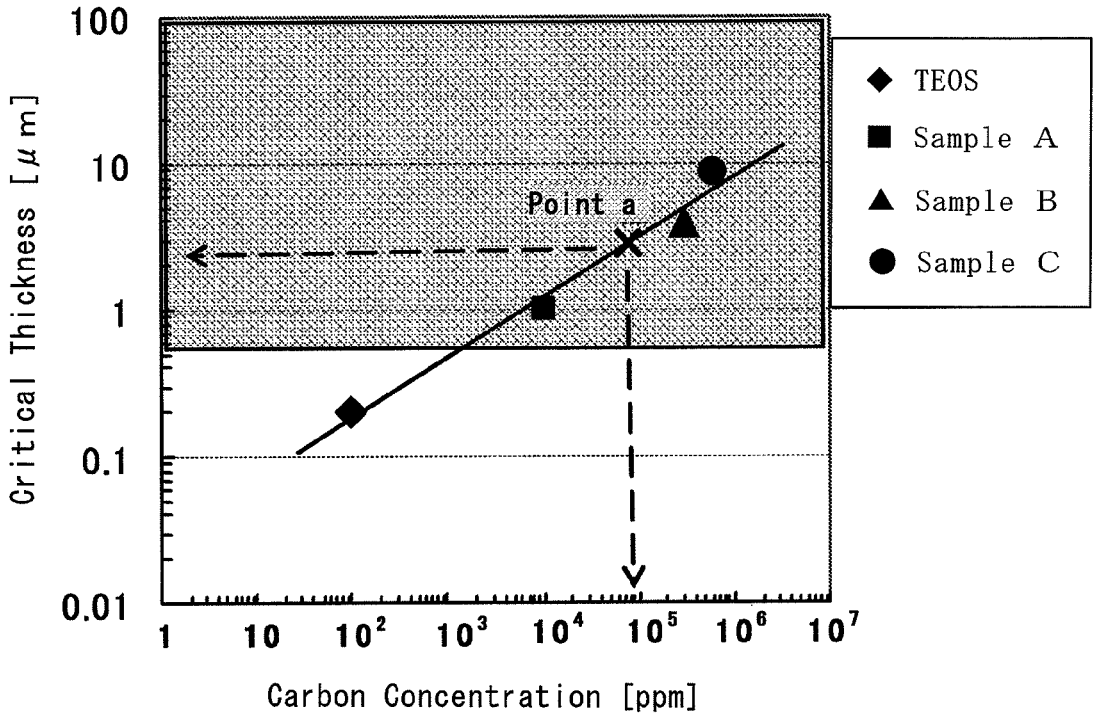
FIG. 3 is a graph showing the carbon concentration versus the critical thickness of the dielectric layer.

FIG. 3 is a graph showing the carbon concentration versus the critical thickness of the dielectric layer, the graph being obtained in Example to be described later. This graph shows the correlation between the carbon concentration (ppm) of the dielectric layer and the critical thickness (μm) of the dielectric layer. "Critical thickness" used in this specification means a dielectric layer thickness beyond which the physical defects (e.g. peeling and cracking) of the dielectric layer can occur. "Peeling or peel-off" used in this specification means that the dielectric layer is peeled off a PDP element (e.g. the substrate or the electrode).

With reference to "point a" shown in the graph, a more detailed explanation will be given below:

In a case where the dielectric layer has the carbon concentration of point a (i.e. the carbon concentration of about $1.0\times 10^5$ ppm), the physical defects such as peeling or cracking tend to occur when the dielectric layer thickness is larger than about 2 μm. While on the other hand, such physical defects are less likely to occur when the dielectric layer thickness is smaller than about 2 μm. These explanations will lead to better understanding of the meaning of the FIG. 3 graph wherein the critical thickness increases as the carbon concentration of the dielectric layer increases.

Figure 4:
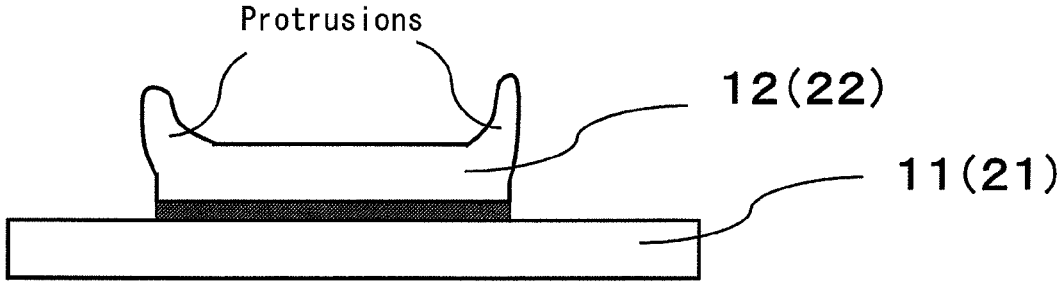
FIG. 4 is a sectional view schematically showing an electrode with protrusions (i.e. "edge curl").
Figure 5:
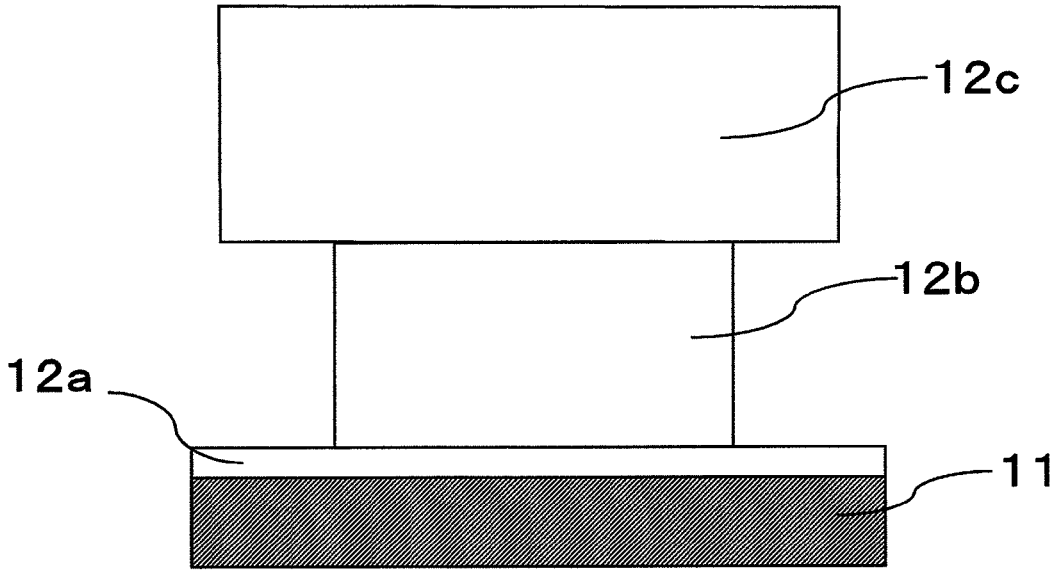
FIG. 5 is a sectional view schematically showing an electrode formed by exposure followed by the development.
Figure 6:
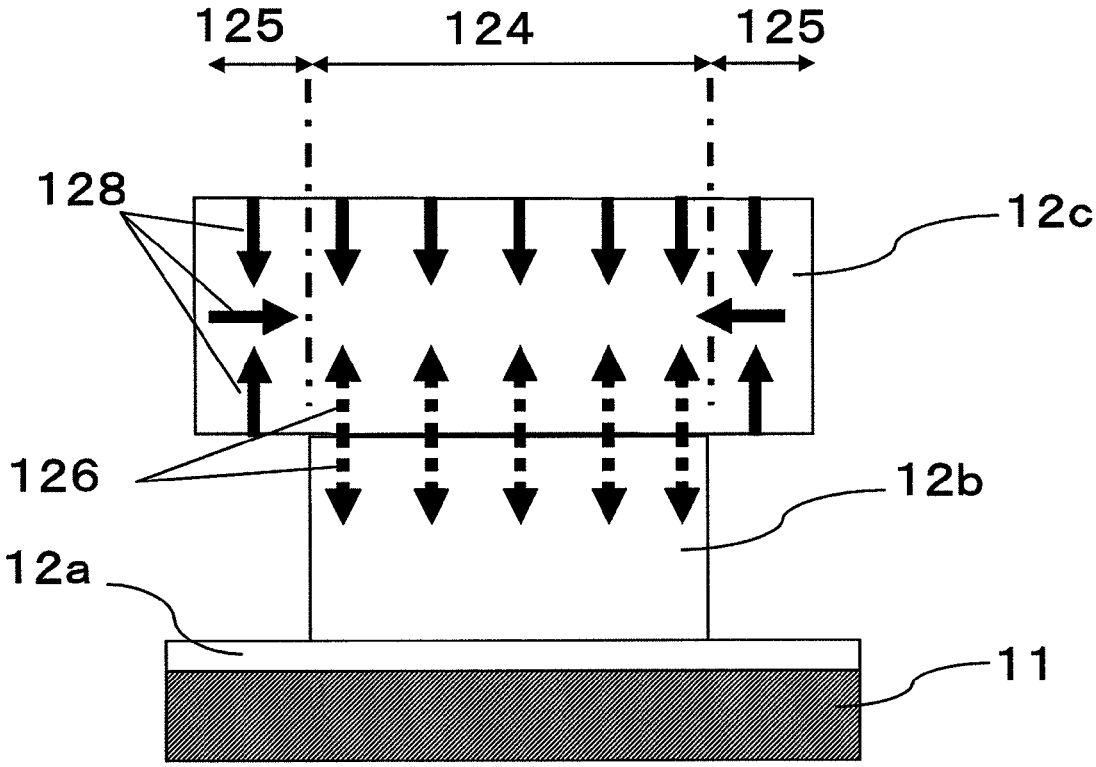
FIG. 6 is a sectional view schematically showing the forces acting when an electrode is calcined after exposure and development.
Figure 7:
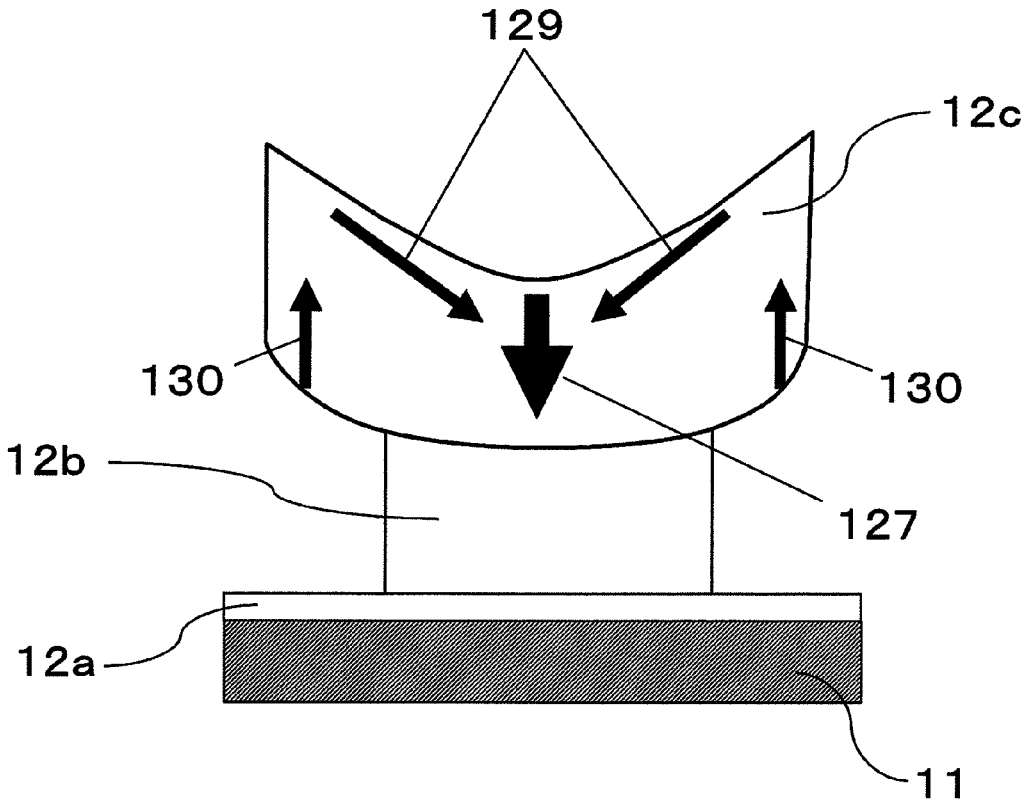
FIG. 7 is a sectional view schematically showing the resultant forces acting when an electrode is calcined after exposure and development.

As described above, the dielectric layer is provided so that the electrodes are covered with the dielectric layer. In this regard, the actual electrodes may have a protrusion (i.e. so-called "edge curl") as shown in FIG. 4. Such protrusion can be formed during the process of calcining the electrodes, which will be described in more detail below:

Lately, for the purpose of improving the contrast of a screen, there has been provided a bus electrode which has a two-layered structure composed of a black layer (i.e. a layer being in contact with a transparent layer) formed on the display side and a white layer formed on the black layer. The black layer is formed by applying a black electrode paste, and the white layer is formed by applying a conductive electrode paste on the black layer. In this regard, as the black electrode paste, a resin composition comprising a black composite oxide of copper-iron (Cu—Fe), copper-chromium (Cu—Cr) or the like is used. In concrete, the bus electrode can be formed from these electrode pastes by applying each of the electrode pastes for each layer, and pattering each of the resulting layers (through exposure and development), followed by calcining each of the resulting layers. Upon the collective exposure of the black layer and the white layer, it may be insufficient for light to reach the lower layer, and thereby the curing of the lower layer becomes insufficient. Consequently, the amount of the insufficiently cured lower layer to be removed during development becomes larger than that of the upper layer. As a result, after the development, the width of the lower layer becomes smaller than the width of the upper layer. The schematic sectional view of such a bus electrode is shown in FIG. 5. When such an electrode is calcined, shrinking forces as shown in FIG. 6 are generated on the white layer and the black layer, respectively, to cause the resultant forces as shown in FIG. 7. In the region 124 where the black layer is left to remain after the development, there is occurred an offset of the interfacial forces from the white layer and the black layer as shown in FIG. 6 during the calcining step. Accordingly, a large force 127 directed to the glass substrate is generated as the resultant force at the surface portion of the white layer, as shown in FIG. 7. In the region 125 where parts of the black layer have been removed during the development, forces 128 shrinking the white layer toward the inside thereof are caused independently of the black layer, as shown in FIG. 6. As a result, as shown in FIG. 7, forces 129 pulling the end portions of the white layer in the widthwise direction to the center portion thereof are caused at the surface of the white layer, due to the resultant force of the large resultant force 127 which is directed to the glass substrate and which acts at the surface of the white layer, with the forces 128 shrinking the white layer toward the inside thereof. When the forces 129 act, the white layer is largely bent, and the end portions of the white layer in the widthwise direction are turned up and are largely projected upward. This eventually produces the protrusions (edge curl) on the electrode as shown in FIG. 4.

In order to cover the electrode having such protrusions with the dielectric layer, thickness of the dielectric layer must be about 0.5 μm or more, preferably about 1.0 μm or more. In other words, the dielectric layer thickness must be about 0.5 μm or more, preferably about 1.0 μm or more so as to cover the edge-curled electrodes. Considering this requirement of the dielectric layer thickness, it can be understood, based on the graph of FIG. 3, that the carbon concentration of the dielectric layer must be about $1.0\times10^3$ ppm or higher, preferably about $1.0\times10^4$ ppm or higher. More specifically, when it is attempted to form the dielectric layer having the thickness of about 0.5 μm or more in view of the coverage of the electrodes, it can be seen from FIG. 3 that the carbon concentration of the first dielectric layer is required to be about $1.0\times10^3$ ppm or higher. In a case where the carbon concentration is lower than $1.0\times10^3$ ppm, there is a possibility that the physical defects such as peeling and cracking occur. Similarly, when it is attempted to form the dielectric layer having the thickness of about 1.0 μm or more in view of the coverage of the electrodes, the carbon concentration of the dielectric layer is required to be about $1.0\times10^4$ ppm or higher according to the graph of FIG. 3.

(Correlation between Carbon Concentration and Heat-resistant Temperature of Dielectric Layer)

Figure 8:
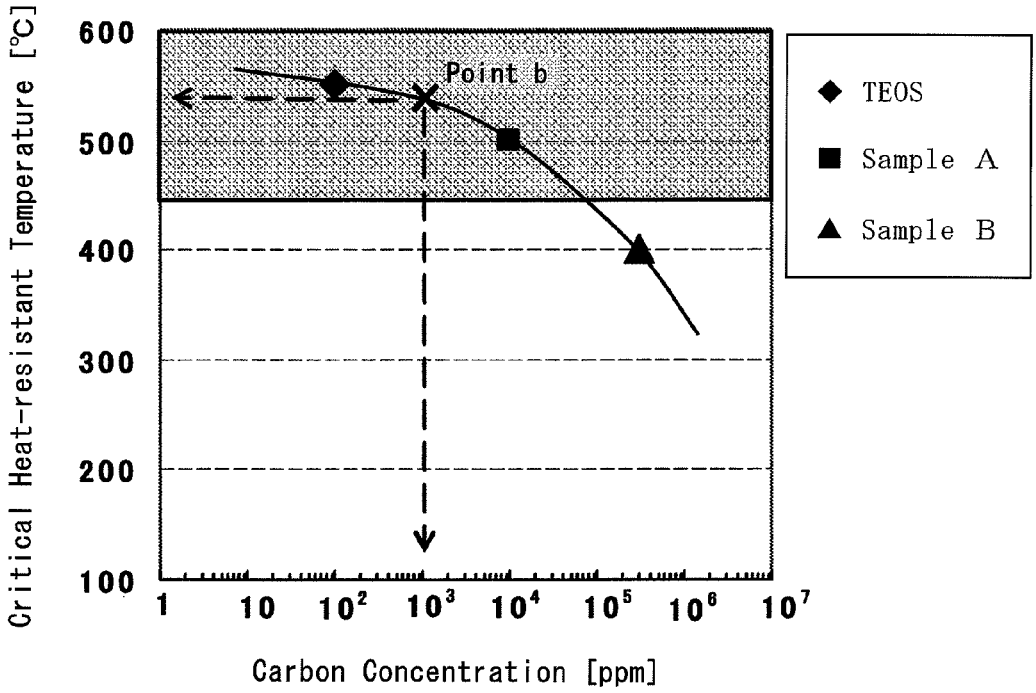
FIG. 8 is a graph showing the carbon concentration versus the critical heat-resistant temperature of the dielectric layer.

FIG. 8 is a graph showing the carbon concentration versus the critical heat-resistant temperature of the dielectric layer, the graph being obtained in Example to be described later. Namely, this graph shows the correlation between the carbon concentration (ppm) of the dielectric layer and the critical heat-resistant temperature (° C.) of the dielectric layer. "Critical heat-resistant temperature" used in this specification means a dielectric layer temperature (° C.) beyond which the physical defects (e.g. peeling or cracking) of the dielectric layer can occur.

With reference to "point b" shown in the graph, a more detailed explanation will be given below:

In a case where the dielectric layer has the carbon concentration of point b (i.e. the carbon concentration of about $1.0\times10^3$ ppm), the physical defects such as peeling or cracking tend to occur when the temperature of the dielectric layer is higher than about 540° C. While on the other hand, such physical defects are less likely to occur when the temperature of the dielectric layer is lower than about 540° C. These explanations will lead to better understanding of the meaning of the FIG. 8 graph wherein the critical heat-resistant temperature decreases as the carbon concentration of the dielectric layer increases.

It should be noted that, the calcining temperature for the phosphor layers upon producing the PDP is about 470° C., and also the temperature for the sealing process in which the front panel and the rear panel are sealed together airtight is about 470° C. In view of this, it is required that the dielectric layer has a heat-resistance at a temperature of approximately 450° C. or higher. It can be therefore seen from FIG. 8 that the carbon concentration of the dielectric layer must be about $1.0\times10^5$ ppm or lower. In other words, when it is taken into consideration that the dielectric layer must have heat-resistance at a temperature of about 450° C. or higher, the carbon concentration of the dielectric layer must be $1.0\times10^5$ ppm or lower according to the graph of FIG. 8. In a case where the carbon concentration is higher than $1.0\times10^5$ ppm, there is a possibility that the physical defects such as peeling and cracking occur.

With respect to the PDP of the present invention, it should be noted that the carbon concentration of the first dielectric layer or of each of the first and the second dielectric layers is in the range of from about $1.0\times10^3$ ppm to about $1.0\times10^5$ ppm, preferably from about $1.0\times10^3$ ppm to about $1.0\times10^4$ ppm. Therefore, the physical defects such as peeling or cracking are suppressed from occurring in the dielectric layer, which leads to a better resistance to dielectric breakdown phenomenon. As a result, a high-definition display is achieved in the PDP of the present invention.

(Correlation between Carbon Concentration and Yellowing Phenomenon)

Figure 9:
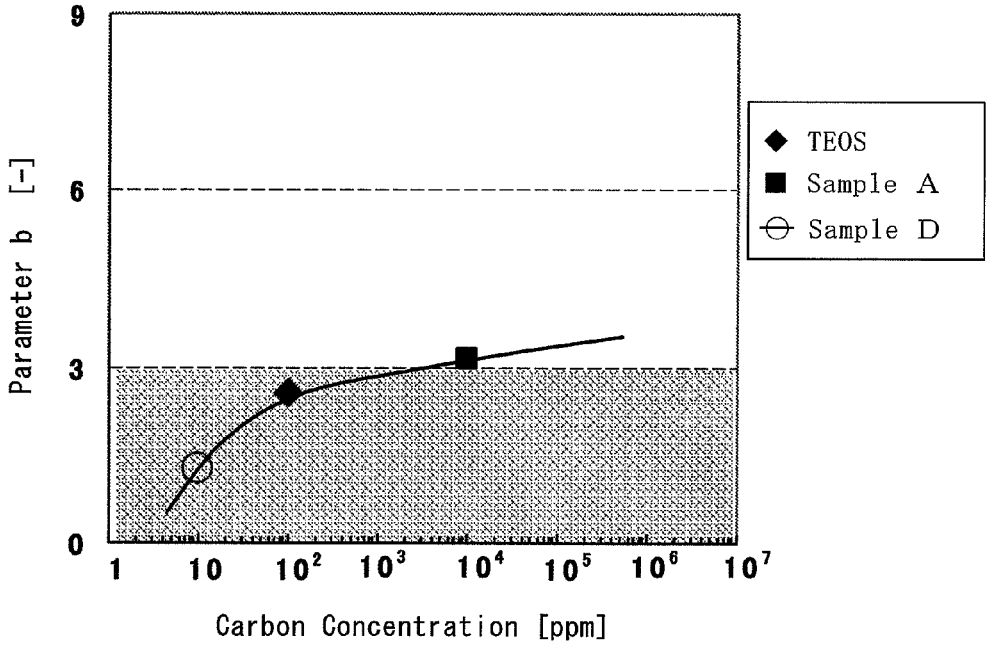
FIG. 9 is a graph showing the carbon concentration versus the parameter b indicating the degree of the yellowing.

FIG. 9 is a graph showing the carbon concentration versus the degree of yellowing, the graph being obtained in Example to be described later. Namely, this graph shows the correlation between the carbon concentration (ppm) of the dielectric layer and the yellowing phenomenon of the dielectric layer. "Yellowing" used in this specification means a discoloration of the dielectric layer, attributable to a reaction between the dielectric layer (or the paste used for forming the dielectric layer) and the electrode (specifically "silver electrode"). "Parameter b" of the vertical axis is a reading of a color meter, and is a well-known index of the degree of discoloration (i.e. yellowish) for the dielectric layer. The larger the positive value of this index becomes, the larger the degree of discoloration (i.e. degree of yellowish color) becomes.

It can be seen from the graph of FIG. 9 that the value of parameter b increases as the carbon concentration of the dielectric layer increases. It is known that the value of parameter b is required to be 3 or lower in order to prevent the display malfunction of the PDP. In other words, when the value of parameter b is 3 or lower, the display function of the PDP can be prevented from being adversely affected by the yellowing of the dielectric layer. In contrast, when the value of parameter b is higher than 3, the display function of the PDP can deteriorate. Considering that parameter b is required to be 3 or lower, the carbon concentration of the dielectric layer must be about $1.0\times10^4$ ppm or lower according to the graph of FIG. 9. In other words, based on the value of parameter b being not higher than 3, it can be seen from the graph of FIG. 9 that the carbon concentration of the dielectric layer is required to be about $1.0\times10^4$ ppm or lower. In a case where the carbon concentration is higher than $1.0\times10^4$ ppm, there is a possibility that the display malfunction of the PDP occurs due to the yellowing phenomenon.

When this requirement (i.e. carbon concentration of $1.0\times10^4$ ppm or lower) determined in term of "yellowing phenomenon" is combined with the above requirement of the carbon concentration of from $1.0\times10^3$ ppm to $1.0\times10^5$ ppm determined in terms of the suppression of the physical defects, it is concluded that the carbon concentration is required to be in the range of from $1.0\times10^3$ ppm to $1.0\times10^4$ ppm so as to prevent not only the physical defects (i.e. peeling or cracking) but also the yellowing phenomenon.

Figure 10:
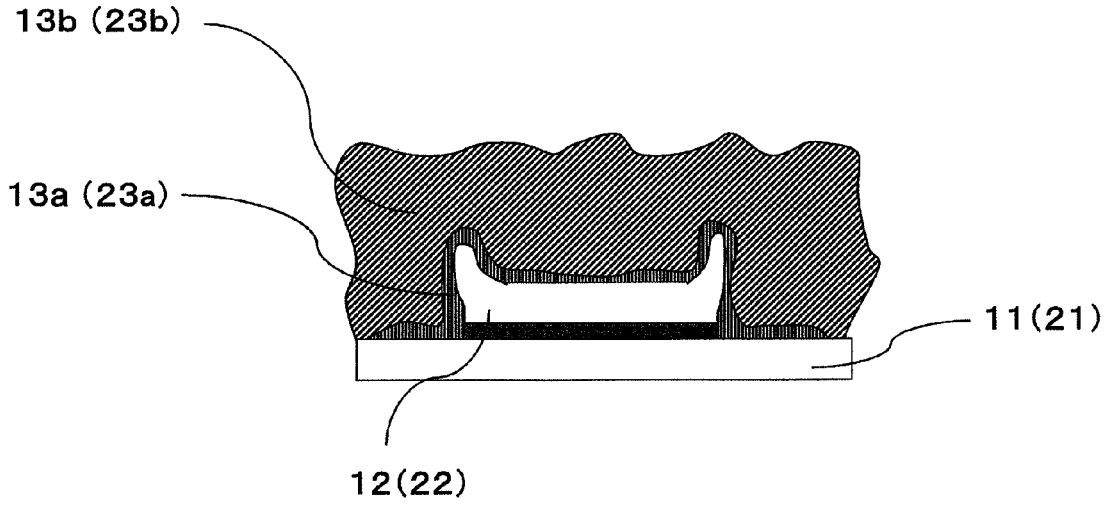
FIG. 10 is a sectional view schematically showing the dielectric layer having a two-layered structure.

It is preferred that the first dielectric layer of. the front panel has a two-layered structure composed of a lower layer 13*a* (i.e. layer being in contact with the electrode) and an upper layer 13*b* (i.e. layer being in contact with the protective layer) as shown in FIG. 10. In this case, it is also preferred that the carbon concentration of the lower layer 13*a* is in the range of from $1.0\times10^3$ ppm to $1.0\times10^4$ ppm, and the carbon concentration of the upper layer 13*b* is in the range of from $1.0\times10^3$ ppm to $1.0\times10^5$ ppm. In this preferred case, the yellowing can be effectively prevented in the lower layer being in contact with the first electrode (e.g. Ag electrode), whereas the physical defects (e.g. peeling or cracking) can be prevented in the upper layer being in no direct contact with the first electrode.

As a result, not only the PDP can have a better resistance to dielectric breakdown phenomenon, but also the decrease of the panel brightness can be effectively prevented. It is preferred that the thickness of the lower layer is in the range of from 0.1 μm to 10 μm. It is preferred that the thickness of the upper layer is in the range of from 5 μm to 40 μm.

The carbon concentration of the lower layer 13*a* may be $1.0\times10^3$ ppm or lower, in which case the yellowing phenomenon can be more effectively prevented.

It is preferred that the carbon contained in the first dielectric layer or in each of the first and the second dielectric layers is derived from an alkyl group bonded to a siloxane backbone (e.g. linear siloxane backbone, cyclic siloxane backbone or three-dimensional network siloxane backbone) as shown below:

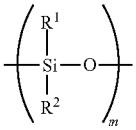

(wherein $R^1$ and $R^2$ represent an alkyl group or a hydrogen atom, and *m* represents an integer of 1 or more.)

In such case, it is preferred that the alkyl group has 1 to 6 carbon atoms. For example, the alkyl group may be a methyl group, an ethyl group, a propyl group, a butyl group, a pentyl group, a hexyl group or the like. The siloxane backbone may contain one or more kinds of these alkyl groups. A functional group bonded to the siloxane backbone of the glass component is not limited to the alkyl group as long as it contains a carbon atom. For example, the carbon contained in the first dielectric layer or in each of the first and the second dielectric layers may be derived from an alkylene group (e.g. a methylene group, an ethylene group, a propylene group or a butylene group).

Hereinafter, the method for producing PDP of the present invention will be described. The method of the present invention substantially relates to a formation of the dielectric layers wherein the dielectric layer of the front panel and the dielectric layer of the rear panel are formed. According to the method of the present invention, the formation of at least one of the front and rear-sided dielectric layers comprises the steps of:

(1) supplying a dielectric material onto a substrate (the substrate being provided with an electrode thereon), the dielectric material comprising an organic solvent and a glass component (the glass component comprising an alkyl or alkylene group and a siloxane backbone in which they bond with each other); and (2) heating the supplied dielectric material. This method of the present invention is characterized in that the dielectric material of the step (1) comprises a glass component wherein the alkyl group is bonded to the siloxane backbone, as shown below:

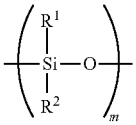

-continued (wherein $R^1$ and $R^2$ represent an alkyl group or a hydrogen atom, and *m* represents an integer of 1 or more.)

Because of this characteristic, the dielectric layer obtained from the dielectric material by the heat treatment of step (2) can have the carbon concentration of from $1.0\times10^3$ ppm to $1.0\times10^5$ ppm.

The siloxane backbone of the glass component of the dielectric material used in the step (1) may be a linear, cyclic or three-dimensional network siloxane backbone. In the glass component, the molar ratio of the alkyl group to Si atom of the siloxane backbone is preferably 1 or more, and more preferably in the range of from 1 to 3. It is preferred that the alkyl group has 1 to 6 carbon atoms (in other words, the number of the carbon atom contained in the alkyl group is in the range of from 1 to 6). The alkyl group may be a methyl group, an ethyl group, a propyl group, a butyl group, a pentyl group, a hexyl group or the like. In this case, the siloxane backbone may contain one or more kinds of these alkyl groups. It should be noted that a functional group bonded to the siloxane backbone of the glass component is not limited to the alkyl group as long as it contains a carbon atom. For example, the glass component may comprise an alkylene group (e.g. a methylene group, an ethylene group, a propylene group or a butylene group) bonded to the siloxane backbone.

In addition to the glass component and the organic solvent, the dielectric material used in the step (1) may further comprise a binder resin if necessary.

It is preferred that the glass component comprises, in addition to the siloxane backbone material (e.g. polyalkylsiloxane), a glass material (e.g. glass frit). Such glass material may be a silicon dioxide ($SiO_2$). In this case, in order to decrease Tg (glass transition temperature) of the silicon dioxide, the glass component preferably contains at least one kind of oxide of a typical element (representative element), selected from the group consisting of sodium oxide ($Na_2O$), potassium oxide ($K_2O$), magnesium oxide (MgO), barium oxide (BaO), lead oxide (PbO) and boron oxide ($B_2O_3$). Examples of the organic solvent include alcohols such as methanol, ethanol, propanol, isopropyl alcohol, isobutyl alcohol, ethylene glycol, propylene glycol and terpineol; ketones such as methyl ethyl ketone and cyclohexane; aromatic hydrocarbons such as toluene, xylene and tetramethylbenzene; glycolethers such as cellosolve, methyl cellosolve, carbitol, methylcarbitol, butylcarbitol, propylene glycol monomethyl ether, dipropylene glycol monomethyl ether and triethylene glycol monomethyl ether; acetate esters such as ethyl acetate, butyl acetate, cellosolve acetate, butyl cellosolve acetate, carbitol acetate, butyl carbitol acetate, propylene glycol monomethyl ether acetate; aliphatic hydrocarbons such as octane and decane; and petroleum-based solvents such as petroleum ether, petroleum naphtha and solvent naphtha. Although each of these organic solvents can be used alone, two or more kinds of them may be used in combination. Examples of the binder resin include a polyvinyl alcohol, a polyvinyl butyral, a methacrylate ester polymer, an acrylate ester polymer, an acrylate ester-methacrylate ester copolymer, an α-methylstyrene polymer and a butyl methacrylate resin. Although each of these binder resins can be used alone, two or more kinds of them may be used in combination.

There is no limitation on the proportions of the components contained in the dielectric material. Such proportions may be those employed in common practice of producing the dielectric layer of typical PDPs. For example, in a case where the dielectric material consists of a glass component and an organic solvent, the proportion of the glass component may be in the range of from 40% by weight to 60% by weight and the proportion of the organic solvent may be in the range of from 60% by weight to 40% by weight. In a case where the dielectric material consists of a glass component, an organic solvent and a binder resin, the proportion of the glass component may be about 55% by weight, the proportion of the organic solvent may be about 40% by weight and the proportion of the binder resin may be about 5% by weight.

"A substrate with an electrode formed thereon" onto which the dielectric material is supplied in the step (1) means "the first substrate whereon the first electrodes are formed" with regard to the process of forming the dielectric layer of the front panel. Specifically, for example, a glass substrate whereon the display electrodes are formed is intended. Similarly, "a substrate with an electrode formed thereon" means "the second substrate whereon the second electrodes are formed" with regard to the process of forming the dielectric layer of the rear panel. Specifically, for example, a glass substrate whereon the address electrodes are formed is intended.

Figure 13:
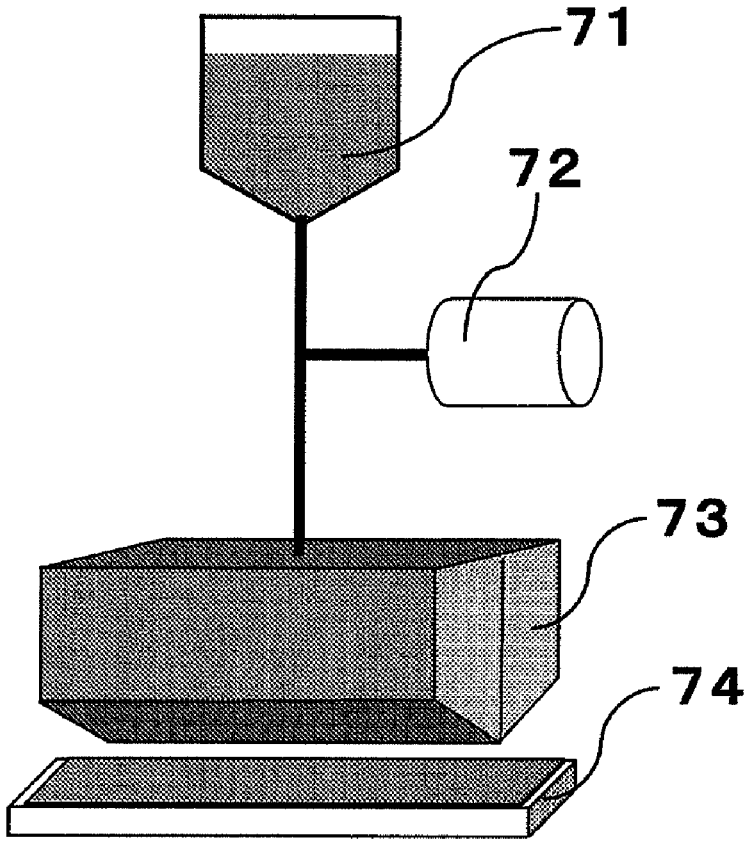
FIG. 13 schematically shows an apparatus for applying a dielectric material paste.

The supply of the dielectric material onto "a substrate with an electrode formed thereon" in the step (1) can be carried out by a dip-coating process (to be described in detail in Example). Alternatively, such supply can be carried out by various methods, for example by means of an apparatus shown in FIG. 13 wherein the dielectric material charged in a tank 71 can be applied onto a substrate 74 through a piping and a nozzle 73 by controlling the speed of syringe motion of a pump 72. A roll coating process, a die coating process, a spin coating process or a blade coating process may be employed. By employing such processes, the dielectric material can be applied onto the substrate in the form of a thin film. There is no limitation on the film thickness, as long as the desired thickness of the dielectric layer can be obtained. For example, the thickness of such thin film may be in the range of from about 1 μm to about 20 μm.

In the step (2), the supplied dielectric material is subjected to heat treatment. "Heating" or "heat treatment" used in this specification and claims substantially means drying and/or calcining. There is no limitation on heating condition as long as it is an ordinary condition suited to the formation of the PDP dielectric layer. For example, the drying may be carried out for from 1 hour to 2 hours under the drying temperature condition of from about 100° C. to about 300° C. The calcination may be carried out for from 1 hour to 2 hours under the calcining temperature condition of from about 400° C. to about 500° C.

Although a few embodiments of the present invention have been hereinbefore described, the present invention is not limited to these embodiments. It will be readily appreciated by those skilled in the art that various modifications are possible without departing from the scope of the present invention.

For example, the heating treatment is not limited to the drying or the calcining, and sputtering, CVD, PVD, EB vapor deposition, plasma gun vapor deposition or sol-gel method may be used to form the dielectric layer. Even in this case, there is occurred no physical defects and yellowing in the dielectric layer as long as it has a carbon concentration of from $10^3$ ppm to $10^5$ ppm.

EXAMPLES

《Test to Obtain Correlation between Carbon Concentration and Dielectric Layer Thickness》

The test was conducted to obtain the correlation between "carbon concentration (ppm) of dielectric layer" and "critical thickness (μm) of dielectric layer". To this end, firstly, a dielectric material paste was applied on a glass substrate (L×W×H:12.5 cm×12.5 cm×1.8 cm, Nippon Electric Glass Co., Ltd.) to form a thin film consisting of the dielectric material. Subsequently, the thin film was dried at 150° C. for 10 minutes, and then was calcined at 500° C. for 1 hour. As a result, a dielectric layer was obtained on the glass substrate.

Specifically, the dielectric layers were formed from the following four kinds of the dielectric material pastes while changing the thickness of the thin film formed on the glass substrate, so as to determine the problem-free thickness above which there is occurred no peeling and no cracking in the dielectric layer (namely, so as to determine the critical thickness of the dielectric layer). In this regard, the carbon concentrations (C concentration) of each dielectric layer were measured to obtain the correlation between the critical film thickness and the carbon concentration.

Figure 11:
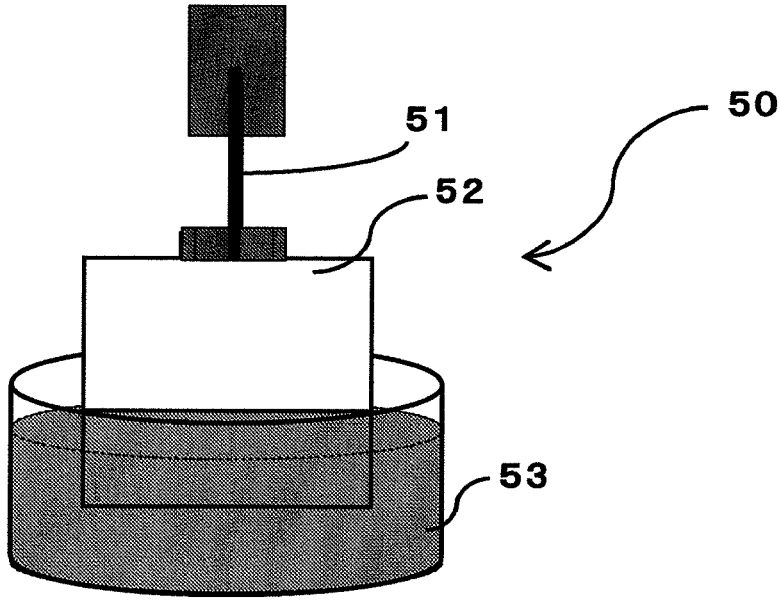
FIG. 11 schematically shows a dipping coating apparatus used in "Test to Obtain Correlation between Carbon Concentration and Dielectric Layer Thickness".

The thickness of the thin film formed on the glass substrate was controlled by a dip-coating method using an apparatus 50 shown in FIG. 11. Specifically, a glass substrate 52 attached to a lift unit 51 was dipped into a tank 53 wherein the dielectric material paste had been charged, and subsequently the glass substrate 52 was lifted from the tank 53 at a constant rate by means of the lift unit 51. If the glass substrate is lifted too fast, surface tension of the paste on the glass substrate 52 becomes predominant over gravity, which leads to an increase in the thickness of the dielectric material film formed on the glass substrate. While on the other hand, if the glass substrate is lifted too slowly, the gravity becomes predominant over the surface tension, which leads to a decrease in the thickness of the dielectric material film. Based on this, the film thickness was controlled by adjusting the speed of lifting up the glass substrate. The film thickness was determined by observing a cross section of the film by means of a scanning electron microscope (SEM), followed by measuring the distance from the interface between the glass substrate and the dielectric layer to the upper surface of the dielectric layer.

The carbon concentration of the dielectric layer was determined by a secondary ion mass spectroscopy (SIMS) wherein a secondary ion was $C^-$ of an atomic weight m/e=12. For a quantitative analysis, an oxide sample with a predetermined amount of C ion injected therein was prepared as a standard sample. The quantitative analysis was conducted by using a sensitivity coefficient of C wherein the sensitivity coefficient of C was calculated from C profile determined by using the intensity of the matrix element (oxygen) of the sample as reference. In a case where the intensity of the C profile of the C ion-injected sample prepared for the measurement was too low, a standard sample with a predetermined amount of Si injected therein was prepared wherein the ratio of sensitivity coefficients of C and Si had been preliminarily determined. In this case, the sensitivity coefficient of Si was calculated from the Si profile, and then the sensitivity coefficient of C was extrapolated by a proportional calculation based on the above ratio, and thereby the concentration of C was finally determined. The analysis was conducted by using SIMS 4500 produced by ATOMIKA under the following conditions Primary ion species: Cs+ for
Incident angle: 30 degrees
Ion energy: 5.0 KeV
Primary ion current: 18 nA
Beam scan length: 18 μm The following four kinds of dielectric materials (referred to as "sample A", "sample B" and "sample C" in the ascending order of contents of alkyl group and alkoxyl group) were used in the test.

TEOS sample: Paste containing 100% by weight of tetraethoxysilane (TEOS) (namely "metal alkoxide-containing sol")

Sample A*: Paste consisting of a solid component composed of silica and polyalkylsiloxane and an organic solvent component composed of isopropyl alcohol, methanol and isobutyl alcohol Sample B*: Paste consisting of a solid component composed of silica and polyalkylsiloxane and an organic solvent component composed of isopropyl alcohol, methanol and isobutyl alcohol Sample C*: Paste consisting of a solid component composed of silica and polyalkylsiloxane and an organic solvent component composed of isopropyl alcohol, methanol and isobutyl alcohol

*Contents (% by weight) of the solid-components in sample A, sample B and sample C are as follows:

Solid Component Content of Sample A:Solid Component Content of Sample B:Solid Component Content of Sample C = 20:50:60

The obtained correlation between the carbon concentration (ppm) of the dielectric layer and the critical thickness (μm) of the dielectric layer is shown as a graph in FIG. 3. It is understood from this graph that the critical thickness increases in proportion to the increase of the carbon concentration of the dielectric layer. The mechanism for this is supposedly as follows: When the network-structured siloxane backbone constituted from Si atoms and O atoms bonded together includes a alkyl group, a mechanical flexibility and a durability of the film are improved, and thereby a stress generated in the film due to the difference in thermal expansion between the dielectric layer and the glass substrate can be mitigated. This will lead to a satisfactory film free from the peeling and the cracking.

《Test to Obtain Correlation between Carbon Concentration and Heat-Resistant Temperature of Dielectric Layer》

The test was conducted to obtain the correlation between "carbon concentration (ppm) of dielectric layer"and "heat-resistant temperature (° C.) of dielectric layer". To this end, firstly, a dielectric material paste was applied on a glass substrate to form a thin film consisting of the dielectric material. Subsequently, the thin film was dried and calcined. As a result, the dielectric layer was obtained on the glass substrate.

Specifically, the dielectric layers were formed from the above raw material pastes while changing the calcining temperature condition, so as to determine the critical temperature below which there is occurred no peeling and no cracking in the dielectric layer (namely, so as to determine the critical heat-resistant temperature of the dielectric layer). In this regard, the carbon concentration of the dielectric layer was measured. The carbon concentration of the dielectric layer was measured by the secondary ion mass spectrometry (SIMS), similarly to the above "Test to Obtain Correlation between Carbon Concentration and Dielectric Layer Thickness".

The obtained correlation between the carbon concentration (ppm) of the dielectric layer and the critical heat-resistant temperature (° C.) of the dielectric layer is shown as a graph in FIG. 8. It will be understood from this graph that the critical heat-resistant temperature decreases in proportion to the increase of the carbon concentration of the dielectric layer. The mechanism for this is supposedly as follows: When the calcining temperature condition is higher, a pyrolysis is accelerated in the dielectric layer, causing the alkyl group to dissociate from the network-structured siloxane backbone constituted from Si atoms and O atoms bonded together. Therefore, the physical defects such as the peeling and/or the cracking tend to occur at higher temperature.

《Test to Obtain Correlation between Carbon Concentration and Yellowing》

Figure 12:
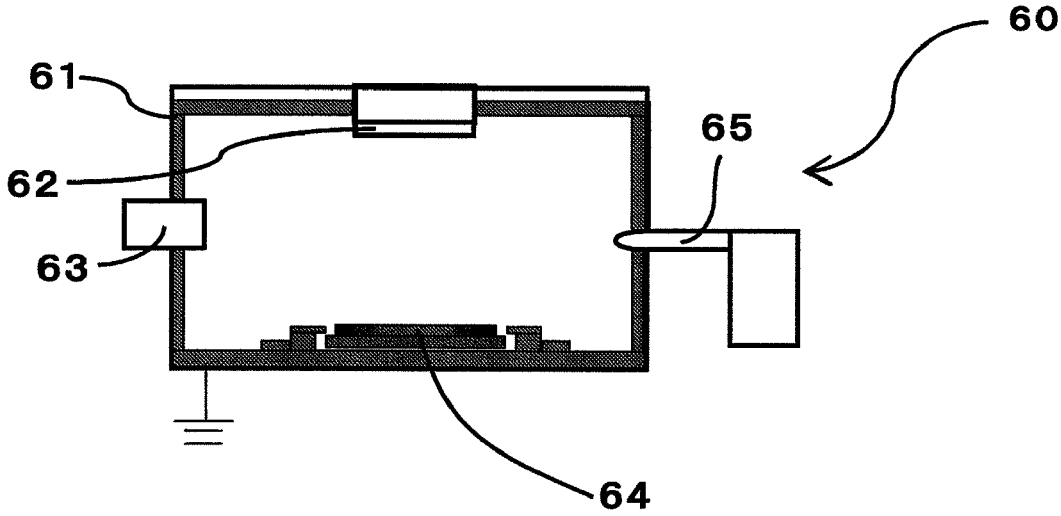
FIG. 12 schematically shows a film forming apparatus used in "Test to Correlation between Carbon Concentration and Yellowing Phenomenon".

The test was conducted to obtain the correlation between "carbon concentration (ppm) of the dielectric layer" and "yellowing phenomenon occurred in the dielectric layer". To this end, a plurality of substrates made of soda lime glass was used, and then the display electrodes and the dielectric layer were successively formed on each of the substrates through the calcining process. As the dielectric material paste, the TEOS sample and the sample A described above were used. In this test, sample D (see FIG. 9) was prepared. Specifically, the sample D was prepared by forming the display electrodes on the substrate, followed by forming an $SiO_2$ film by a sputtering process by means of an apparatus 60 shown in FIG. 12. It should be noted that this $SiO_2$ film can be regarded as equivalent to the dielectric layer (whose mains component is also silicon oxide). In the sputtering process, a target 64 for forming film on the substrate 62 was prepared by introducing various gases through a gas inlet 63 into a vacuum chamber 61. During this, a partial pressure of each gas introduced into the chamber 61 was monitored by means of a quadrupole mass spectrometer (Qmass) 65. The film forming conditions were as follow:

Output power: 1 kW

Sputtering pressure: 1.0 Pa

Gas flow rate: 100 sccm for Ar and 10 sccm for $O_2$

Substrate temperature: 250 to 350° C.

Film thickness: 1 μm.

"Yellowing" of the obtained dielectric layer was evaluated by determining the value of parameter b (index of the degree of yellowish discoloration) by means of a color meter (NF999, Nippon Denshoku Industries Co., Ltd.).

The obtained correlation between the carbon concentration (ppm) of the dielectric layer and the value of parameter b is shown as a graph in FIG. 9. It is understood from this graph that the value of b increases in proportion to the increase of the carbon concentration of the dielectric layer. In particular, considering that the value of parameter b of 3 or lower is necessary to avoid the adverse effect on the display function of the PDP, it will be understood that the carbon concentration of the dielectric layer must be $1.0\times10^4$ ppm or lower.

Now, the mechanism of the above correlation (i.e. mechanism why the value of b increases in proportion to the increase of the carbon concentration) will be described. In general, the yellowing phenomenon of the panel is supposed to be caused due to the reaction between silver of the electrodes and the dielectric layer during the time course of the calcining process. It is known that the colloidal aggregation of the silver causes the yellowing phenomenon. In a case where the dielectric layer contains a large amount of the carbon-containing groups (e.g. alkyl group), voids could be formed in the dielectric layer by the evaporation or dissipation of such groups due to the breaking of the bonding during the calcining process. As a result, the active silver ions can diffuse into the voids. In this case, as the calcining temperature becomes lower, the movement of the silver ions decreases, and thereby the diffused and isolated silver particles tend to aggregate, thus resulting in the occurrence of the yellowing phenomenon. Accordingly, it can be assumed that the carbon concentration of $10^4$ ppm or lower served to prevent the formation of more voids in the dielectric layer during the calcining process, and thereby the silver ion diffusion could be prevented, which resulted in the prevention of the yellowing phenomenon.

In this test, it was additionally confirmed that the similar results could be obtained even by employing the CVD process using TEOS gas for forming SiO film. In this regard, this SiO film was prepared by supplying $O_2$ at a flow rate of 700 sccm, He at a flow rate of 150 sccm and TEOS at a flow rate of 0.25 liters per minute and setting the pressure to 5.9 Pa, followed by carrying out a discharge step with RF output power of 700 W and BIAS=100 W.

The dielectric layer of the PDP of the present invention is substantially free from not only the physical defects such as peeling-off or cracking, but also the yellowing. Therefore, the present invention can contribute to an achievement of a higher definition, a lower power consumption and a higher efficiency of the plasma display panels.

What is claimed is:

1. A plasma display panel comprising:

a front panel comprising a first substrate, a first electrode, a first dielectric layer and a protective layer, the first electrode being formed on the first substrate, the first dielectric layer being formed over the first substrate so as to cover the first electrode, and the protective layer being formed on the first dielectric layer; and a rear panel comprising a second substrate, a second electrode, a second dielectric layer and a phosphor layer, the second electrode being formed on the second substrate, the second dielectric layer being formed over the second substrate so as to cover the second electrode, and the phosphor layer being formed on the second dielectric layer, wherein the front panel and the rear panel are disposed so that the protective layer and the phosphor layer are opposed to each other, and thereby a discharge space is formed between the front panel and the rear panel;

at least the first dielectric layer has a carbon concentration of $10^3$ ppm to $10^5$ ppm, wherein the carbon is derived from an alkyl or alkylene group bonded to a siloxane backbone, the siloxane backbone being contained in at least one of the first dielectric layer and the second dielectric layer;

each of the first and second electrodes has an edge curl; and a dielectric layer is disposed between the first dielectric layer and the first electrode, and has a carbon concentration of $10^4$ ppm or lower.

2. A plasma display panel comprising:

a front panel comprising a first substrate, a first electrode, a first dielectric layer and a protective layer, the first electrode being formed on the first substrate, the first dielectric layer being formed over the first substrate so as to cover the first electrode, and the protective layer being formed on the first dielectric layer; and a rear panel comprising a second substrate, a second electrode, a second dielectric layer and a phosphor layer, the second electrode being formed on the second substrate, the second dielectric layer being formed over the second substrate so as to cover the second electrode, and the phosphor layer being formed on the second dielectric layer, wherein the front panel and the rear panel are disposed so that the protective layer and the phosphor layer are opposed to each other, and thereby a discharge space is formed between the front panel and the rear panel;

at least the first dielectric layer has a carbon concentration of $10^3$ ppm to $10^5$ ppm, wherein the carbon is derived from an alkyl or alkylene group bonded to a siloxane backbone, the siloxane backbone being contained in at least one of the first dielectric layer and the second dielectric layer;

each of the first and second electrodes has an edge curl;

the first dielectric layer has a two-layered structure composed of a lower layer and an upper layer, the lower layer being in contact with the first electrode and the upper layer being in contact with the protective layer; and the lower layer has the carbon concentration of $10^3$ ppm to $10^4$ ppm, and the upper layer has the carbon concentration of $10^3$ ppm to $10^5$ ppm.

* * * * *